US005634238A

United States Patent [19]

McCaffrey et al.

[11] Patent Number: 5,634,238

[45] Date of Patent: Jun. 3, 1997

[54] PICK-UP HEAD FOR A VACUUM CLEANER

[75] Inventors: Andrew F. McCaffrey, Reading; Peter D. Rickett, Windsor, both of United Kingdom

[73] Assignee: VAX Limited, Droitwich, United Kingdom

[21] Appl. No.: 411,675

[22] PCT Filed: Oct. 6, 1993

[86] PCT No.: PCT/GB93/02074

§ 371 Date: May 8, 1995

§ 102(e) Date: May 8, 1995

[87] PCT Pub. No.: WO94/08501

PCT Pub. Date: Apr. 28, 1994

[30] Foreign Application Priority Data

Oct. 8, 1992 [GB] United Kingdom ..... 9221178

[51] Int. Cl.[6] ..... A47L 7/00

[52] U.S. Cl. ..... 15/353; 15/322; 15/344; 15/415.1

[58] Field of Search ..... 15/321, 353

[56] References Cited

U.S. PATENT DOCUMENTS

| | | | |
|---|---|---|---|
| 4,179,769 | 12/1979 | Lundquist | 15/353 |
| 4,216,563 | 8/1980 | Cyphert | 15/353 X |
| 4,341,540 | 7/1982 | Howerin | 15/353 X |
| 4,798,613 | 1/1989 | Hetherington et al. | 15/353 X |
| 4,821,366 | 4/1989 | Levine . | |
| 5,020,187 | 6/1991 | Kosten et al. . | |
| 5,210,902 | 5/1993 | Lee et al. | 15/321 X |
| 5,263,224 | 11/1993 | Lovelady | 15/322 X |
| 5,341,541 | 8/1994 | Sham | 15/353 X |

FOREIGN PATENT DOCUMENTS

| | | |
|---|---|---|
| 0170720 | 2/1986 | European Pat. Off. . |
| 0215165 | 3/1987 | European Pat. Off. . |
| 0357189 | 3/1990 | European Pat. Off. . |
| 1503858 | 7/1969 | Germany . |

*Primary Examiner*—Chris K. Moore
*Attorney, Agent, or Firm*—Spencer & Frank

[57] ABSTRACT

An attachment for connection to a suction hose of a vacuum cleaner for enabling liquid to be picked up from a surface and collected by the attachment. The attachment comprises a hollow body defining a collection container for receiving and collecting liquid therein; an outlet member defining an outlet and including a connector adapted to be connected to the suction hose; a pick-up inlet member defining an inlet adapted to pick up liquid from the surface; and a flow path member extending in a flow path between the container and the outlet member. The flow path member defines a flow restricting orifice adjacent a side wall of the container and near an upper end of the container, the orifice having a cross-sectional area significantly less than that of the outlet and that of the inlet; an air expansion chamber disposed in a flow path between the orifice and the outlet; a vortex chamber disposed in a flow path upstream of and adjacent the orifice, the vortex chamber including a curved wall defining a concave flow surface extending across the flow path member from a position opposite the orifice to a position adjacent the orifice such that a flow off the concave flow surface is directed generally away from the orifice; and an element for reversing the flow off the concave flow surface from a direction generally away from the orifice to a direction toward the orifice.

14 Claims, 2 Drawing Sheets

10
14
16
16
17
20
21
22
23
23
23
23
32
34
35
40
41
42
43
45
46
47
48
48
49
50
52
52
53
60

17
18
21
42
43
45
45
49
50
51
52
52

PICK-UP HEAD FOR A VACUUM CLEANER

FIELD OF THE INVENTION

This invention relates to pick-up heads for vacuum cleaners, i.e. suction operated appliances for use primarily on floors and floor coverings, and usually having attachments available for specific cleaning operations. More particularly, this invention is concerned with a pick-up head to form part of such an attachment for picking up liquid and which comprises a pick-up head with a collection container for liquid and a suction hose for connection to an inlet of the vacuum cleaner which serves as a source of suction for the attachment.

BACKGROUND OF THE INVENTION

A liquid pick-up head or describe above is disclosed in German specification 1503858, in which the suction hose is connected to the in-use upper end of the collection container, and a which the interior of the container communicates with a suction chamber by way of a tube of generally inverted J-shape so arranged that liquid picked up by the application of suction to the suction chamber travels upwardly along the longer limb of the tube and is discharged downwardly from the shorter limb of the tube adjacent to a side wall of the collection container.

Such an arrangement does not afford very efficient separation of entrained liquid droplets, and accordingly significant quantities of moisture may be drawn through the suction hose and into the vacuum cleaner, with possible deleterious effect.

According to the invention, we provide a pick-up head for use with a vacuum cleaner and comprising a hollow body defining a collection container to receive and collect liquid, an outlet leading from the container and including a connector for connection to a source of suction, and a pickup inlet for application to a surface from which liquid is to be picked up. Upstream of the outlet the collection container has an air outlet opening which comprises a flow-restricting orifice having a cross-sectional area which is significantly less than that of the outlet.

Conveniently, an air expansion chamber is provided between the orifice and the outlet.

Preferably, the flow-restricting orifice is disposed adjacent to a side wall of the collection container, at or near the in-use upper end of the container.

According to a particularly preferred feature of the invention, adjacent the flow-restricting orifice there is provided a vortex chamber which includes a curved wall forming a concave air-flow directing surface which extends across the collection container from a position adjacent to a side wall thereof opposite to the side wall at which the flow-restricting orifice is provided a position adjacent the orifice and such that air-flow off the concave surface is directed generally away from the orifice and is required to undergo a reversal of direction to enter the orifice.

The expansion chamber may be in part defined by the curved wall.

A filter element is preferably provided between the orifice and the outlet.

The pick-up inlet may be in the form of an elongated slot which extends between lateral side walls of the collection chamber, preferably at a position adjacent the side wall at which the orifice is provided, and a suction duct may extend from the slot to a discharge outlet which is disposed within the collection container at a position between the slot and the orifice.

In accordance with a further preferred feature of the invention, the discharge outlet is arranged adjacent the side wall of the collection container at which the orifice is provided, and is arranged to face the orifice, an air-flow reversing deflector being disposed between the discharge outlet and the orifice, whereby air-flow from the suction duct undergoes a reversal of direction and enters the collection container flowing in a direction away from the orifice and at a position spaced from the wails of the container.

BRIEF DESCRIPTION OF THE DRAWINGS

These and other features of the invention will now be described by way of example with reference to the accompanying drawings wherein.

DETAILED DESCRIPTION OF THE INVENTION

Figure 1:
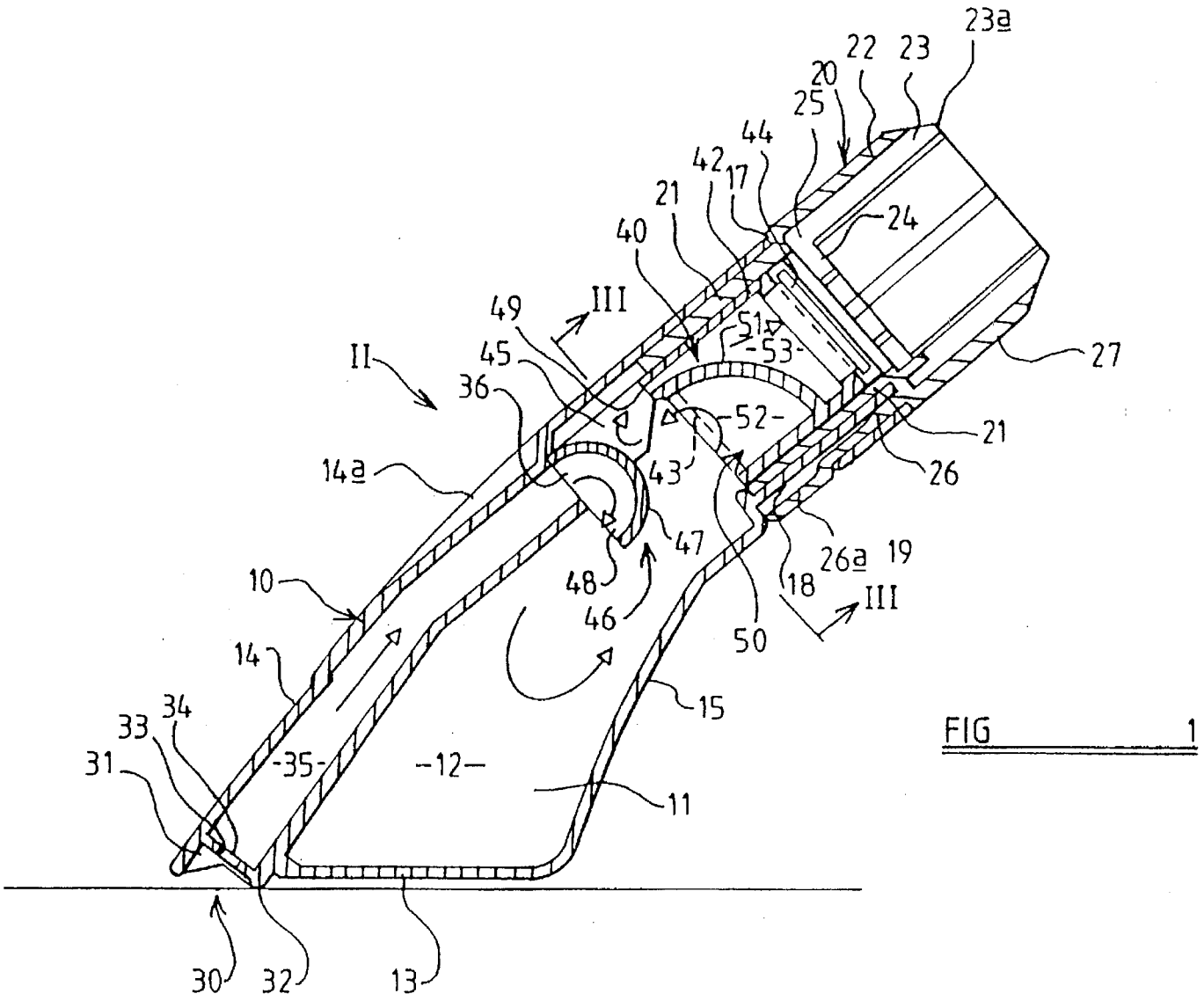
FIG. 1 shows a longitudinal section through one specific embodiment of a pick-up head according to the invention which is intended for connection to a suction hose.
Figure 2:
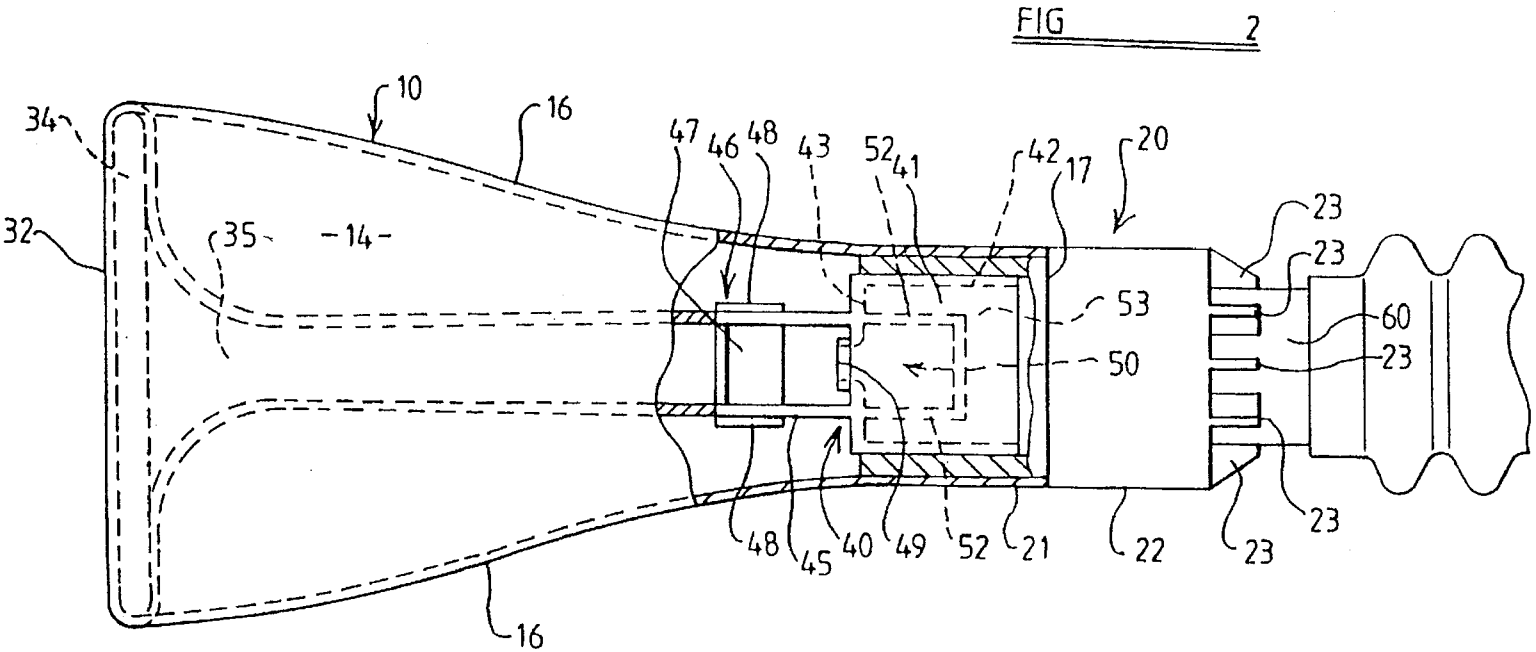
FIG. 2 shows the pick-up head in the direction of arrow II of FIG. 1 partially sectioned and connected to a suction hose.
Figure 3:
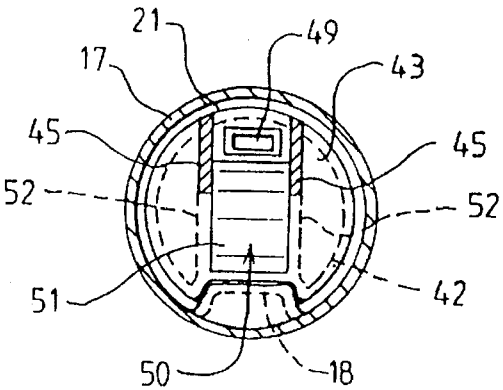
FIG. 3 shows a transverse section of the pick-up head along line III—III of FIG. 1.

The accompanying drawings illustrate a hand-held suction pick-up head for use as an accessory attachment with a conventional vacuum cleaner. The suction head 10 is intended for the purpose of picking up relatively small quantities of cleaning liquid, e.g. typically about 200 c.cs, as may be applied to a localised area of a carpet or other floor covering for the purpose of removing localised heavy soiling. In the embodiment illustrated, the suction head is not provided with any means for delivering a cleaning liquid, and it is intended that the same would be applied manually by the user. However, it will be appreciated that the cleaning head as illustrated could be modified to include liquid delivery, means of any appropriate kind, either from a suitable reservoir container formed or provided on the head itself, or from a separate reservoir by means of an appropriate supply pipe. The head can, of course, also be used for picking up small spillages of liquid as well as the cleaning liquid.

As illustrated, the suction head 10 includes a hollow body 11 which defines a liquid collection container 12 generally bounded by a lower wall 13, front wall 14, rear wall 15 and lateral side wails 16. At its upper end, the hollow body 11 defines a tubular outlet 17, through which liquid collected in the container 12 can be emptied, and through which, in use, suction is applied.

For this purpose the tubular outlet 17 receives a connection member 20 comprising a tubular spigot 21 which is in a close friction fit within the outlet 17, and a socket 22 adapted to receive an end fitting 60 of a flexible suction hose.

A flexible tongue 26 which is formed or provided on the connection member 20 is arranged to enter an internal longitudinal slot 18 formed on the wall of the tubular outlet 17 of the suction head, and an off-set portion **26*a* of the tongue is adapted to enter a corresponding aperture 19 formed in the wall of the tubular outlet 17 as illustrated at the innermost end of the slot 18**.

The socket 22 comprises a cylindrical side wall 27 formed internally with a plurality of longitudinally extending circumferentially spaced ribs 23 which project radially inwardly from the wall sill 27 of the socket 22 and which at the inner end of the socket terminate in further radially projecting inward extensions 24. The diametral spacing between the inwardly presented faces of the ribs 23 is such as to receive the hose end fitting as a tight friction fit, and the extensions 24 serve as end stops whereby an annular gap 25 exists between the hose end fitting and the inner end of the socket 22. The above arrangement enables air to be drawn in along the axial passageways which are defined between the ribs 23 in order to provide an air-bleed passageway which reduces the suction applied to the suction head 10.

As illustrated, the ribs 23 may project outwardly beyond the end of the side wall of the socket 22, and be chamfered as indicated at 23*a*, whereby a user may grip the assembly of tubular outlet 17 and socket 22 in the palm of the hand and regulate the air-bleed by obstructing the axial passageways to a greater or lesser extent, thereby varying the suction power applied to the suction head.

The air-bleed facility helps to reduce the air-flow through the suction head, thereby assisting the prevention of excessive turbulence which might tend to cause the contents of the liquid collection container 12 to be drawn up into the suction hose.

The lower wall 13 of the suction head is formed with a liquid pick-up inlet 30, which comprises a transversely extending elongate suction chamber 31 bounded by a downwardly projecting peripheral rib 32, and an upper wall 33 which is arranged obliquely relative to the mouth of the suction chamber as defined by the lower edge of the peripheral rib, as best seen in FIG. 1. The upper wall 33 is formed with a longitudinally extending slot 34 through which suction is applied to the chamber 31. The suction slot 34 opens into a suction duct 35 which is provided on the inner face of the front wall 14 of the liquid collection container 12. The duct 35 includes an upwardly converging inlet portion leading to a generally parallel-sided portion which terminates in a discharge outlet 36 at a position near to the tubular outlet 17, but spaced therefrom. As can be seen, the discharge outlet 36 is directed towards the tubular outlet 17.

To ensure that liquid picked up through the pick-up inlet 30 is separated from the air-flow which is induced by means of a suction applied through the suction hose, and collected in the container 12, in accordance with the invention an air/liquid separating fitting 40 is provided.

The fitting 40 comprises a hollow plug 41 which is received within the tubular spigot 21 of the connection member 20, the plug having a cylindrical wall 42 which is closed at the innermost end by means of an end wall 43, and at its outer end receives a filter element 44.

A pair of arms 45 extend away from the end wall 43 at one side of the fitting, and at their free ends carry a deflector 46 which comprises a semi-cylindrical wall 47 with corresponding semi-circular end walls 48. The axial length of the deflector 46 corresponds to the width of the discharge outlet 36 and effectively defines an end portion of the suction duct 35 in which the direction of air-flow is reversed so that the stream of air and liquid entrained therein from the suction chamber 30 is delivered into the collection container 12 at a generally central position spaced from the side wails 14,15, 16.

This sharp reversal of air-flow ensures that most of the liquid entrained in the air-flow is separated out. A further reversal in the direction of the air-flow is required to enable the air stream to flow towards the tubular outlet 17.

However, in accordance with the invention, communication between the interior of the collection container 12 and the hose attached to the connection member 20 is by way of a flow-restricting orifice 49 formed in the end wall 43 of the plug at a position adjacent to the cylindrical wall 42 and between the arms 45.

The orifice 49 significantly restricts the air-flow through the suction head, and its small dimensions, as well as the shielding afforded by the arms 45 and deflector 46, create a significant obstacle to droplets of liquid still entrained in the air-flow, the majority of which will be efficiently removed by contact with the various surfaces which effectively define a tortuous air passageway.

In accordance with a further feature of the invention, this effect is enhanced by the provision of a vortex chamber 50 immediately adjacent to the orifice 49. The vortex chamber 50 is defined within the plug 41 by a curved wall 51, which affords a concave surface directed towards the interior of the collection container 12, and by side walls 52 in alignment with the arms 45 and extending from the end wall 43 into the interior of the plug. The curved wall 51 extends from a position immediately adjacent to the orifice 49 inwardly of the hollow plug 41, and terminates at the cylindrical wall 42 of the plug on the side thereof opposite the side at which the orifice 49 is provided.

The vortex chamber 50, thus defined, provides for a third reversal of the direction of air-flow towards the orifice 49 and sets up a vortex which further assists in the separation of any entrained droplets of liquid. Since the air-flow from the concave face of the curved wall 51 is then directed away from the orifice 49, a fourth reversal of direction is required before the air-flow exits from the collection container 12, again assisting separation of any remaining entrained droplets of liquid.

The interior of the hollow plug 41, bounded in part by the cylindrical wall 42 and the curved wall 51 serves as an expansion chamber 53 which gives rise to a substantial reduction in the velocity of air-flow at this point and this provides a still further separation of entrained droplets, and the filter element 44 may serve to retain any remaining droplets before the air-flow passes out of the suction head and into the suction hose. The filter element is preferably in the form of a mesh made of filaments of material which provides a mechanical barrier to water droplets whilst allowing collected water to drip back from the element when air-flow ceases.

The front wall 14 of the collection container 12 may be formed with a central thumb recess as illustrated at 14*a* to facilitate gripping of the suction head by the user, and a movable thumb-piece may be provided within the recess for longitudinal sliding movement towards and away from the orifice 49, the thumb piece having a downward extension adapted to close the orifice 49 when the thumb piece is not moved away from the orifice against a spring-bias, so that when the user releases the suction head the orifice 49 is automatically closed in order to prevent liquid leaking out of the collection container and into the suction hose.

To empty the collection container after use, it is merely necessary to remove the connection member 20, together with the fitting 40, and to tip away the contents of the container through the outlet 17. The fitting 40 can be removed from the connection member 20 to enable the filter element 44 to be cleaned or replaced.

We claim:

1. An attachment for connection to a suction hose of a vacuum cleaner for enabling liquid to be picked up from a surface and collected by the attachment, the attachment comprising:

a hollow body defining a collection container for receiving and collecting liquid therein;

an outlet member disposed to be in flow communication with the container, the outlet member defining an outlet and including a connector adapted to be connected to the suction hose;

a pick-up inlet member disposed to be in flow communication with the container, the inlet member defining an inlet adapted to be applied to the surface for picking up liquid therefrom;

a flow path member extending in a flow path between the container and the outlet member, the flow path member defining:

a flow restricting orifice adjacent a side wall of the container and near an upper end of the container, the orifice thereby being disposed upstream of the outlet and further having a cross-sectional area significantly less than that of the outlet and that of the inlet;

an air expansion chamber disposed in a flow path between the orifice and the outlet;

a vortex chamber disposed in a flow path upstream of and adjacent the orifice, the vortex chamber including a curved wall defining a concave flow surface extending across the flow path member from a position opposite the orifice to a position adjacent the orifice such that a flow off the concave flow surface is directed generally away from the orifice; and a means for reversing the flow off the concave flow surface from a direction generally away from the orifice to a direction toward the orifice.

2. The attachment according to claim 1, wherein the curved wall partially defines the air expansion chamber.

3. The attachment according to claim 2, wherein the inlet is disposed adjacent a side wall of the container nearest the orifice.

4. The attachment according to claim 3, wherein the hollow body further includes a suction duct extending from the inlet toward the flow path member, the suction duct defining a discharge outlet at an end thereof adjacent the flow path member upstream of the orifice.

5. The attachment according to claim 4, wherein:

the discharge outlet is disposed adjacent the side wall of the container nearest the orifice, the discharge outlet further facing in a direction towards the orifice; and the flow path member includes a flow reversing deflector disposed in a flow path between the discharge outlet and the orifice, whereby flow from the suction duct undergoes a reversal of direction and enters the container at a position spaced from side walls of the container and flowing in a direction away from the orifice.

6. The attachment according to claim 5, wherein:

the connector includes a plug member which fits within the outlet such that the orifice, the vortex chamber and the expansion chamber are formed in the plug member, and such that the deflector is part of the plug member.

7. The attachment according to claim 1, wherein the connector includes a plug member which fits within the outlet such that the orifice, the vortex chamber and the expansion chamber are formed in the plug member.

8. The attachment according to claim 1, wherein the flow path member further includes a filter element disposed in the flow path between the orifice and the outlet.

9. The attachment according to claim 1, wherein the pick-up inlet member is an elongated slot extending between lateral side walls of the collection container.

10. An attachment for connection to a suction hose of a vacuum cleaner for enabling liquid to be picked up from a surface and collected by the attachment, the attachment comprising:

a hollow body defining a collection container for receiving and collecting liquid therein;

an outlet member disposed to be in flow communication with the container, the outlet member defining an outlet and including a connector adapted to be connected to the suction hose;

a pick-up inlet member disposed to be in flow communication with the container, the inlet member defining an inlet adapted to be applied to the surface for picking up liquid therefrom;

a flow path member extending in a flow path between the container and the outlet member, the flow path member defining a flow restricting orifice disposed upstream of the outlet and having a cross-sectional area significantly less than that of the outlet and that of the inlet, the flow path member further including a filter element disposed in the flow path between the orifice and the outlet.

11. An attachment for connection to a suction hose of a vacuum cleaner for enabling liquid to be picked up from a surface and collected by the attachment, the attachment comprising:

a hollow body defining a collection container for receiving and collecting liquid therein;

a pick-up inlet member disposed to be in flow communication with the container, the inlet member defining an inlet adapted to be applied to the surface for picking up liquid therefrom;

an outlet member disposed to be in flow communication with the container, the outlet member defining an outlet and including a connector adapted to be connected to the suction hose, the connector comprising a socket adapted to receive an end fitting of the suction hose and being configured to define an air-bleed passageway to an interior region of the outlet member;

a flow path member extending in a flow path between the container and the outlet member, the flow path member defining a flow restricting orifice disposed upstream of the outlet and having a cross-sectional area significantly less than that of the outlet and that of the inlet.

12. The attachment according to claim 11, wherein the socket includes a plurality of longitudinally extending circumferentially spaced internal ribs adapted to receive and set a positioning of the end fitting of the suction hose, the air bleed passageway including an annular gap located around the end fitting when the end fitting is received by the internal ribs of the socket.

13. The attachment according to claim 12, wherein the ribs include inwardly projecting extensions adapted to serve as end stops for the end fitting of the suction hose.

14. The attachment according to claim 12, wherein the ribs extend in a longitudinal direction beyond the socket and include chamfered ends, a user thereby being able to regulate an air bleed through the ribs by gripping the socket for obstructing the air bleed passageway to varied extents.

* * * * *